US008536798B2

(12) United States Patent
Matsuda et al.

(10) Patent No.: US 8,536,798 B2
(45) Date of Patent: Sep. 17, 2013

(54) LED DRIVE CIRCUIT, LED ILLUMINATION COMPONENT, LED ILLUMINATION DEVICE, AND LED ILLUMINATION SYSTEM

(75) Inventors: Hideo Matsuda, Osaka (JP); Atsushi Kanamori, Osaka (JP); Takayuki Shimizu, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 231 days.

(21) Appl. No.: 13/217,350

(22) Filed: Aug. 25, 2011

(65) Prior Publication Data

US 2012/0068617 A1 Mar. 22, 2012

(30) Foreign Application Priority Data

Sep. 22, 2010 (JP) ..... 2010-211565

(51) Int. Cl.
*H05B 37/02* (2006.01)

(52) U.S. Cl.
USPC ..... 315/291; 315/194; 315/307; 315/308

(58) Field of Classification Search
USPC ..... 315/291, 307, 308, 194, 195, 196, 315/224, 246, 247
See application file for complete search history.

(56) References Cited

U.S. PATENT DOCUMENTS

| | | | | |
|---|---|---|---|---|
| 7,791,326 | B2 * | 9/2010 | Dahlman et al. | 323/284 |
| 7,888,881 | B2 * | 2/2011 | Shteynberg et al. | 315/291 |
| 2008/0224629 | A1 * | 9/2008 | Melanson | 315/247 |
| 2009/0058467 | A1 | 3/2009 | Gong et al. | |
| 2010/0066266 | A1 | 3/2010 | Huang et al. | |
| 2011/0204803 | A1 * | 8/2011 | Grotkowski et al. | 315/194 |

FOREIGN PATENT DOCUMENTS

| | | | |
|---|---|---|---|
| JP | 59-90389 | A | 5/1984 |
| JP | 5-54982 | A | 3/1993 |
| JP | 2004-327152 | A | 11/2004 |
| JP | 2005-26142 | A | 1/2005 |
| JP | 2006-319172 | A | 11/2006 |
| JP | 2007-35403 | A | 2/2007 |
| JP | 2010-73689 | A | 4/2010 |
| KR | 10-0878435 | B1 | 1/2009 |

* cited by examiner

*Primary Examiner* — David H Vu
(74) *Attorney, Agent, or Firm* — Birch, Stewart, Kolasch & Birch, LLP

(57) ABSTRACT

An LED drive circuit is provided that is connectable to a phase-control light controller and drives an LED load by use of a voltage obtained by rectifying a phase-controlled alternating current voltage inputted from the phase-control light controller. The LED drive circuit includes: a first phase angle detection portion that detects a phase angle in a present cycle; a second phase angle detection portion that detects a phase angle in a cycle preceding the present cycle by at least one cycle; a bias portion that generates a detection signal by adding a predetermined delay time to a phase angle obtained by averaging the phase angle detected by the first phase angle detection portion and the phase angle detected by the second phase angle detection portion; and a drive portion that starts current supply to the LED load at timing based on the detection signal generated by the bias portion.

13 Claims, 18 Drawing Sheets

LED DRIVE CIRCUIT, LED ILLUMINATION COMPONENT, LED ILLUMINATION DEVICE, AND LED ILLUMINATION SYSTEM

This application is based on Japanese Patent Application No. 2010-211565 filed on Sep. 22, 2010, the contents of which are hereby incorporated by reference.

BACKGROUND OF THE INVENTION

1. Field of the Invention

The present invention relates to an LED drive circuit that directly drives an LED (light-emitting diode) by use of a voltage obtained by rectifying alternating current power, and to an LED illumination component, an LED illumination device, and an LED illumination system that use the LED drive circuit.

2. Description of the Prior Art

An LED is characterized by its low current consumption, long life, and so on, and its range of applications has been expanding not only to displays but also to illumination apparatuses and the like. An LED illumination apparatus often uses a plurality of LEDs in order to attain desired illuminance.

A general-use illumination apparatus often uses a commercial AC 100 V power source, and considering, for example, a case where an LED illumination component is used in place of a general-use illumination component such as an incandescent lamp, it is desirable that, similarly to a general-use illumination component, an LED illumination component also be configured to use a commercial AC 100 V power source.

Furthermore, in seeking to perform light control of an incandescent lamp, a phase-control light controller (referred to generally as an incandescent light controller) is used in which a switching element (generally, a thyristor element or a triac element) is switched on at a certain phase angle of an alternating current power source voltage and that thus allows light control through control of power supply to the incandescent lamp to be performed easily with a simple operation of a volume element (see, for example, JP-A-2005-26142).

It is desirable that in seeking to perform light control of an LED illumination component that uses an AC power source, the LED illumination component be connectable as it is to an existing phase-control light controller for an incandescent lamp. By changing only an illumination component from an incandescent lamp to an LED illumination component while using existing light control equipment therewith, compared with a case of using the incandescent lamp, power consumption can be reduced considerably (see, for example, JP-A-2006-319172). Furthermore, this can also secure compatibility without requiring the light control equipment to be changed to a type used exclusively for an LED illumination component and thus reduces equipment cost. Furthermore, an LED illumination apparatus takes any of many various forms such as a lamp for main illumination, an electric bulb, a downlight, an under-shelf light, and a lamp for indirect illumination and uses a power source technique suitable for the form it takes.

Examples of such a power source technique include an AC/DC method in which an LED is driven by use of a DC voltage obtained by smoothing AC power and an AC direct drive method in which an LED is driven directly by use of a voltage obtained by rectifying AC power. The methods as the power source techniques have their respective characteristics, and there are two types of the AC/DC method: a voltage step-up type and a voltage step-down type. Either of these types, while allowing high-efficiency driving of an LED, involves driving an LED by use of a DC voltage obtained by smoothing an alternating current voltage with a voltage smoother, which leads to the complication of a circuit and requires that a transformer, a coil, and a capacitor having large time constants be used selectively and thus that components having relatively large volumes be used.

On the other hand, in the AC direct drive method, while this method is somewhat less efficient compared with the AC/DC method, an LED is turned off if a rectified input voltage is smaller than a forward voltage obtained when the LED starts to glow. The LED is turned off in repeated cycles of 100 Hz to 120 Hz obtained by rectifying a frequency of 50 Hz to 60 Hz of a general-purpose power source. In a case of a camera or the like, if this timing synchronizes with imaging timing of the camera, a large variation in brightness is perceived, which, however, is hardly perceivable to the human eye due to an extremely short blinking cycle. Also, this method involves directly driving the LED by use of a rectified voltage, thus providing a relatively simple configuration including a reduced number of components and requiring no high-profile components such as a coil and a capacitor, and is therefore used favorably for a thin power module. For example, in a case of an illumination apparatus such as an under-shelf light, a power module that takes up only a limited space is required, and thus it is best to use the AC direct drive method.

Now, FIG. 14 shows a configuration of a conventional incandescent lamp illumination system. The incandescent lamp illumination system shown in FIG. 14 includes a phase-control light controller 2, a diode bridge DB1, and an incandescent lamp 41. FIG. 20 shows a configuration example of the phase-control light controller 2, in which a resistance value of a variable resistor Rvar1 is made to vary, and a triac Tri1 is thus switched on at a power source phase angle depending on the resistance value. Typically, the variable resistor Rvar1 is built in the form of a rotary knob or a slider and so configured that changing an angle of rotation of the knob or the position of the slider allows light control of an illumination component. Moreover, in the phase-control light controller 2, a capacitor C1 and an inductor L1 constitute a noise suppression circuit that reduces noise fed back into an alternating current power source line from the phase-control light controller 2.

FIG. 16 shows as one example voltage and current waveforms at various parts of the system in a case where the incandescent lamp 41 is driven while being light-controlled by the phase-control light controller 2. In FIG. 16, there are shown a waveform of an output voltage V1 of the phase-control light controller 2, a waveform of a voltage V41 across the incandescent lamp 41, and a waveform of a current I41 flowing through the incandescent lamp 41. When the triac Tri1 included in the phase-control light controller 2 is switched from an off-state to an on-state, the voltage V41 across the incandescent lamp 41 increases sharply, and thus the current I41 flowing through the incandescent lamp 41 also increases sharply, so that the incandescent lamp 41 is turned on. After that, during the time the triac Tri1 is on, the current continues to flow through the incandescent lamp 41, and the turned-on state of the incandescent lamp 41 is thus maintained as long as the output voltage V1 of the phase-control light controller 2 has a value higher than around 0 V.

It is known, however, that also in performing light control of the incandescent lamp 41 with the phase-control light controller 2 as shown in FIG. 14, the use of a low-wattage incandescent lamp as the incandescent lamp 41 leads to the occurrence of flickering and blinking, making it impossible to perform the light control properly. The output voltage of the light controller rises at a threshold voltage of the triac Tri1 included in the phase-control light controller 2. This rising timing varies considerably in response to fluctuations of an alternating current power source 1, so that a light control phase angle varies. When the light amount is low, the ratio of the amount of this variation in phase angle increases, which leads to the occurrence of flickering.

It is desired that in seeking to perform light control of an LED illumination component that uses an alternating current power source, a phase-control light controller be used as in a case of performing light control of an incandescent lamp. Now, FIG. 15 shows a conventional example of an LED illumination system capable of performing light control of an LED illumination component that uses an alternating current power source. The LED illumination system shown in FIG. 15 includes a phase-control light controller 2, a diode bridge DB1, an LED module 3, a current limitation circuit 4, and a drive portion 5. FIG. 17A shows waveforms of a voltage V2 generated at a positive side output end of the diode bridge DB1 and a current ILED of the LED module 3 in a case where a light control level is set to a high brightness level, and FIG. 17B shows those in a case where the light control level is set to a low brightness level.

In a case where the light control level is set to a high brightness level, a triac Tri1 included in the phase-control light controller 2 is switched from an off-state to an on-state at a small phase angle (for example, 40°) to cause the voltage V2 generated at the positive side output end of the diode bridge DB1 to rise sharply (see FIG. 17A), upon detection of which the drive portion 5 starts passing a current through the LED module 3, so that the LED module 3 is turned on. After that, the current flowing though the LED module 3 is controlled so as to be constant by the current limitation circuit 4, and the turned-on state of the LED module 3 is thus maintained during the time a voltage across the LED module 3 is higher than a forward voltage obtained when the LED module 3 starts to glow. Furthermore, in a case where the light control level is set to a low brightness level, the triac Tri1 is switched from the off-state to the on-state at a large phase angle (for example, 130°) to cause the voltage V2 generated at the positive side output end of the diode bridge DB1 to rise sharply (see FIG. 17B), so that the LED module 3 is turned on.

FIG. 18 shows a VF-IF curve (relationship between a forward voltage and a forward current) of each of the incandescent lamp 41 and the LED module 3. Each of the incandescent lamp 41 and the LED module 3 is driven by use of a constant current (I4*a*, Ia), and a comparison between these cases indicates that during a time period in which an applied forward voltage is high (Vf>V4*a*, Va), a predetermined current (I4*a*, Ia) flows through each of the incandescent lamp 41 and the LED module 3, whereas during a time period in which the applied forward voltage is low (Vf<V4*a*, Va), based on the relationships shown in FIG. 18, the constant current (14*a*, Ia) can no longer be passed, and thus there occurs a decrease in current flowing through each of the incandescent lamp 41 and the LED module 3. For example, at a certain forward voltage (V4*b*, Vb), a current (I4*b*, Ib) is obtained. Now, FIG. 19 shows temporal changes in forward voltage applied to the LED module 3 and in current in the LED module 3. In a case where the light control level is set to a low brightness level and the phase angle is large, for example, in FIG. 19, when the forward voltage rises at timing t1, the current in the LED module 3 has a value I1. Then, when, after the occurrence of a variation Δtj in phase angle from the timing t1 to timing t2, the forward voltage rises at the timing t2, the current in the LED module 3 has a value I2. Based on the VF-IF curve of the LED module 3 shown in FIG. 18, with the forward voltage having a value Va or lower, the current in the LED module 3 decreases abruptly, and thus a variation ΔIj in current in the LED module 3 with respect to the variation Δtj in phase angle is large.

With the alternating current power source 1 having a frequency of 50 Hz to 60 Hz, when a light-emitting element is driven directly by use of a voltage rectified by the diode bridge DB1, blinking occurs repeatedly at 100 Hz to 120 Hz, which, however, is too fast for the human eye to follow and thus is perceived as if the light-emitting element is glowing continuously. In order to maintain brightness at a constant level, it is required that the current in the LED module 3 be set to have a constant value in every cycle. Generally speaking, however, various devices are connected to the alternating current power source 1, so that an output voltage of the alternating current power source 1 fluctuates in various cycles. As a result, there occurs a variation in switching timing of the triac Tri1 included in the phase-control light controller 2 to cause a minute variation in phase angle. In a case where the light control level is set to a low brightness level, this results in a large variation in current in the LED module 3, and when alternating current power fluctuates at a low frequency (for example, a little higher than 10 Hz or lower), such a variation can be followed by the human eye and thus is perceived in the form of flickering.

Furthermore, the amount of the above-described variation is relatively small when a light emission duration of the LED module 3 is long and relatively large when the light emission duration of the LED module 3 is short. For example, if the switching timing of the triac Tri1 varies by 40 μs, at a phase angle of 30°, the amount of the variation is substantially 1%, i.e. there occurs no noticeable degree of change in light (luminance), whereas at a phase angle of 130° or larger, there occurs a noticeable degree of change in light (luminance).

SUMMARY OF THE INVENTION

It is an object of the present invention to provide an LED drive circuit, an LED illumination component, an LED illumination device, and an LED illumination system that are capable of reducing the occurrence of flickering in an LED load under low-luminance light control due to fluctuations in alternating current power.

An LED drive circuit of the present invention is an LED drive circuit that is connectable to a phase-control light controller and drives an LED load by use of a voltage obtained by rectifying a phase-controlled alternating current voltage inputted from the phase-control light controller. The LED drive circuit includes: a first phase angle detection portion that detects a phase angle in a present cycle; a second phase angle detection portion that detects a phase angle in a cycle preceding the present cycle by at least one cycle; a bias portion that generates a detection signal by adding a predetermined delay time to a phase angle obtained by averaging the phase angle detected by the first phase angle detection portion and the phase angle detected by the second phase angle detection portion; and a drive portion that starts current supply to the LED load at timing based on the detection signal generated by the bias portion.

According to this configuration, even if a phase angle of an output voltage of the phase-control light controller minutely varies in every cycle due to fluctuations in alternating current power, since a detection signal is generated by adding a predetermined delay time to an averaged phase angle and current supply to the LED load is started at timing based on the detection signal, the occurrence of flickering in the LED load under low-luminance light control can be reduced.

Furthermore, a positive threshold voltage and a negative threshold voltage of a switching element in the phase angle control light controller may have different values from each other. Even in such a case, by performing averaging, for example, in every cycle, a positive phase angle and a negative phase angle can be averaged. Furthermore, by performing averaging, for example, in every two cycles, positive phase angles and negative phase angles can be averaged, respectively.

Furthermore, in the above-described configuration, the bias portion may include a delay circuit having: a capacitor; a charging/discharging circuit that discharges the capacitor, which has been charged to a predetermined voltage, by use of a first constant current for a time period of a phase angle in a cycle preceding the present cycle by one cycle detected by the second phase angle detection portion, charges the capacitor by use of the first constant current for a time period of the phase angle in the present cycle detected by the first phase angle detection portion, and then further charges the capacitor by use of a second constant current; and a detection circuit that detects that the a voltage of the capacitor has attained a predetermined voltage after the charging of the capacitor by use of the second constant current.

Furthermore, in the above-described configuration, the bias portion may include a delay circuit having: a capacitor; a charging/discharging circuit that discharges the capacitor, which has been charged to a predetermined voltage, by use of a first constant current for a time period of a phase angle in a cycle preceding the present cycle by two cycles detected by the second phase angle detection portion, charges the capacitor by use of the first constant current for a time period of the phase angle in the present cycle detected by the first phase angle detection portion, and then further charges the capacitor by use of a second constant current; and a detection circuit that detects that a voltage of the capacitor has attained a predetermined voltage after the charging of the capacitor by use of the second constant current.

Furthermore, in any of the above-described configurations, absolute values of the first constant current and the second constant current or the ratio between the first constant current and the second constant current may set to be externally adjustable.

According to this configuration, a delay time and an averaging rate can be externally adjusted in accordance with the degree of fluctuations in alternating current power.

Furthermore, in any of the above-described configurations, the drive portion may be configured to stop the current supply to the LED load when the detection signal generated by the bias portion has a voltage not higher than a predetermined voltage and start the current supply to the LED load at a predetermined time constant when the detection signal generated by the bias portion has a voltage exceeding the predetermined voltage.

According to this configuration, current supply to the LED load is slowly started when a detection signal generated by the bias portion has a voltage exceeding a predetermined voltage, and thus a variation in current due to a variation in phase angle can be reduced, so that the occurrence of flickering in the LED load can be further reduced.

Furthermore, in any of the above-described configurations, in a power supply line of the LED load, a filter may be provided that reduces switching noise generated upon switching-on of a switching element in the phase-control light controller.

This configuration can reduce the occurrence of flickering in the LED load due to switching noise generated upon switching-on of a switching element in the phase-control light controller.

Furthermore, an LED illumination component of the present invention includes: an LED drive circuit having any of the above-described configurations; and the LED load that is connected to an output side of the LED drive circuit.

Furthermore, an LED illumination device of the present invention includes: an LED drive circuit having any of the above-described configurations; or an LED illumination component having the above-described configuration.

Furthermore, an LED illumination system of the present invention includes: either of an LED illumination component having the above-described configuration and an LED illumination device having the above-described configuration; and the phase-control light controller that is connected to an input side of the either of the LED illumination component and the LED illumination device.

DESCRIPTION OF THE PREFERRED EMBODIMENTS

Figure 1:
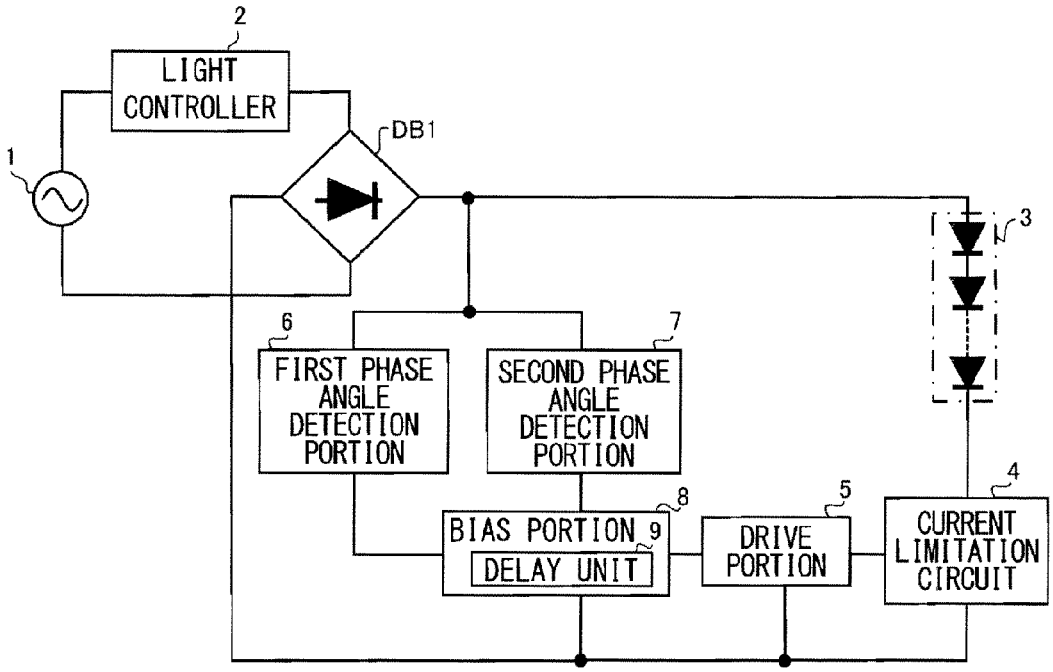
FIG. 1 is a diagram showing a configuration example of an LED illumination system according to the present invention.
Figure 2:
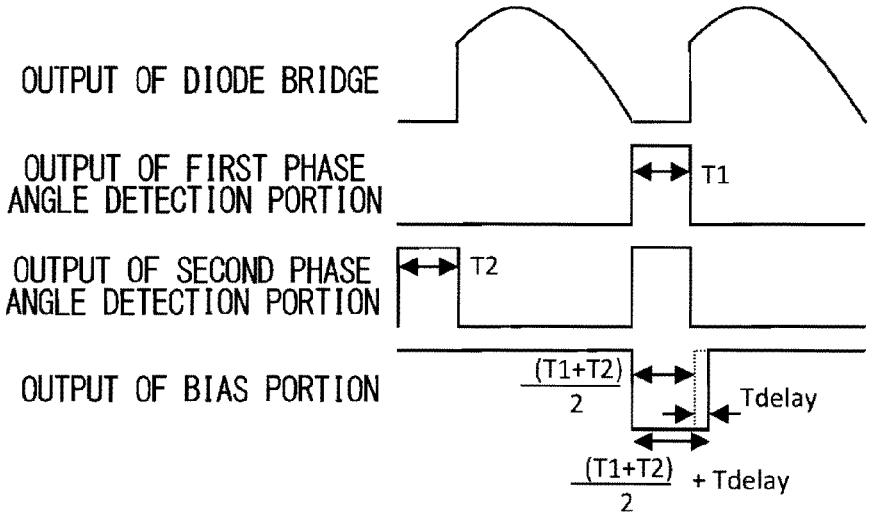
FIG. 2 is a diagram showing output waveforms at various parts of an LED drive circuit according to the present invention.

Hereinafter, an embodiment of the present invention will be described with reference to the appended drawings. FIG. 1 shows a configuration example of an LED illumination system according to the present invention. In the LED illumination system shown in FIG. 1, an LED drive circuit includes a diode bridge DB1, a current limitation circuit 4, a drive portion 5, a first phase angle detection portion 6, a second phase angle detection portion 7, and a bias portion 8, and the bias portion 8 has a delay unit 9. An alternating current voltage, which has undergone phase control by a light controller 2, is full-wave rectified by the diode bridge DB1, and a voltage having a pulsation waveform shown in FIG. 2 is thus outputted from the diode bridge DB1. The voltage having the pulsation waveform is outputted to each of the first phase angle detection portion 6 and the second phase angle detection portion 7 and also to an LED module 3.

The first phase angle detection portion 6 detects a length of time from a zero-crossing point of an output voltage of the diode bridge DB1 to a rising edge thereof in a present cycle, i.e. a phase angle in the present cycle (T1 in FIG. 2). The second phase angle detection portion 7 detects a length of time from a zero-crossing point of the output voltage of the diode bridge DB1 to a rising edge thereof in an immediately preceding cycle, i.e. a phase angle in the immediately preceding cycle (T2 in FIG. 2). The bias portion 8 generates an average phase angle detection signal by adding a predetermined delay time (Tdelay in FIG. 2) to a phase angle obtained by averaging the phase angle in the present cycle detected by the first phase angle detection portion 6 and the phase angle in the immediately preceding cycle detected by the second phase angle detection portion 7 and outputs it to the drive portion 5 ("Output of bias portion" in FIG. 2). The drive portion 5 then starts current supply to the LED module 3 at rising timing of the average phase angle detection signal. Upon the start of the current supply to the LED module 3, a current flowing though the LED module 3 is controlled by the current limitation circuit 4 connected in series to the LED module 3 so as to have a value not higher than a predetermined value. This can prevent an excessive current from being generated due to an excessive voltage applied.

Thus, even if the phase angle varies in every cycle, since the LED module 3 can be driven at timing of an averaged phase angle, the occurrence of flickering in the LED module 3 particularly under low-luminance light control can be reduced.

Particularly in a case where the length of time (T2 in FIG. 2) from zero-crossing timing to rising edge detection timing in the immediately preceding cycle is shorter than the length of time (T1 in FIG. 2) from zero-crossing timing to rising edge detection timing in the present cycle, a resulting averaged phase angle is shorter than the length of time from zero-crossing timing to rising edge detection timing in the present cycle. In this case, even if an attempt is made to drive the LED module 3 at timing of the averaged phase angle, the LED module 3 has not yet been supplied with a voltage when such timing is reached, and thus a current cannot be passed through the LED module 3.

As a solution to this, in this embodiment, the bias portion 8 includes the delay unit 9 thereby to generate an average phase angle detection signal by adding a predetermined delay time (Tdelay in FIG. 2) to an averaged phase angle and output it to the drive portion 5. In a case where the drive portion 5 drives the LED module 3 at rising timing of this average phase angle detection signal, the LED module 3 has been supplied with a voltage when such timing is reached, and thus a current can be passed through the LED module 3. This can expand an averaging range for determining driving timing of the LED module 3.

Figure 3:
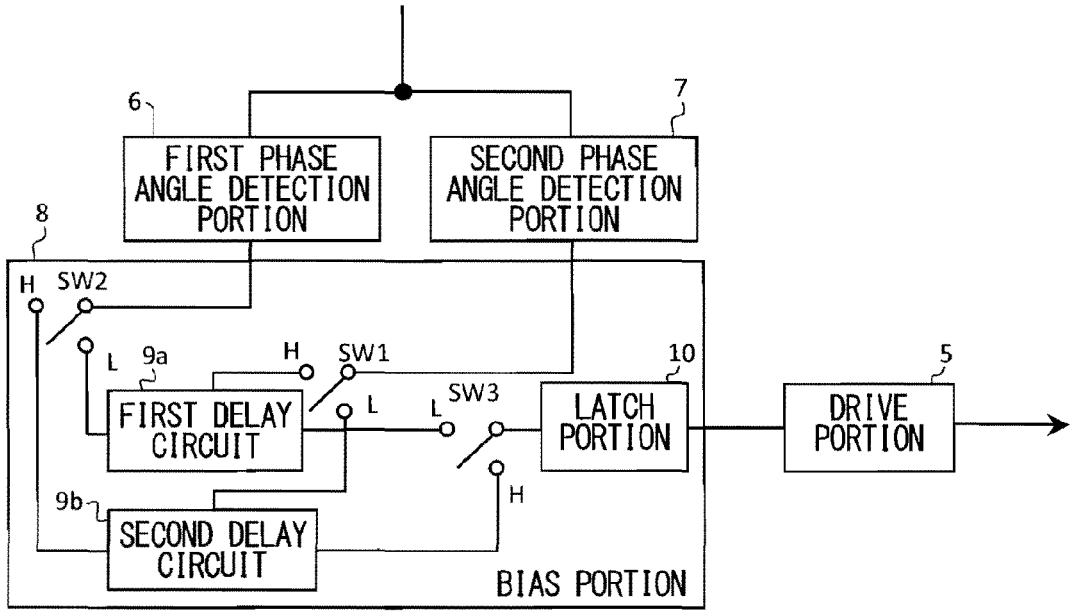
FIG. 3 is a diagram showing a specific configuration example of a bias portion of the LED drive circuit according to the present invention.

Now, FIG. 3 shows a specific configuration example of the bias portion in this embodiment. The bias portion 8 has a first delay circuit 9*a* and a second delay circuit 9*b* as the delay unit 9, switches SW1 to SW3, and a latch portion 10. The switch SW1 is a switch for switching between the first delay circuit 9*a* and the second delay circuit 9*b* as a destination of an output of the second phase angle detection portion 7, the switch SW2 is a switch for switching between the first delay circuit 9*a* and the second delay circuit 9*b* as a destination of an output of the first phase angle detection portion 6, and the switch SW3 switches between the first delay circuit 9*a* and the second delay circuit 9*b* and based on a result of the switching, outputs an output of either the first delay circuit 9*a* or the second delay circuit 9*b* to the latch portion 10.

Figure 4:
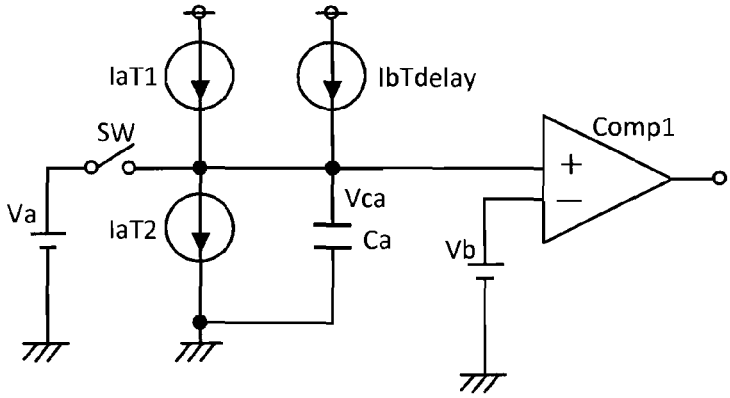
FIG. 4 is a diagram showing a specific configuration example of a delay circuit.

FIG. 4 shows a specific configuration example of each of the first delay circuit 9*a* and the second delay circuit 9*b*. The delay circuit described here includes constant current sources IaT1, IaT2, and IbTdelay, a capacitor Ca, a comparator Comp1, and a switch SW. The constant current source IaT1 and the constant current source IaT2 are connected in series with a ground, and the constant current source IbTdelay and the capacitor Ca are also connected in series with the ground. Via the switch SW, a reference voltage Va is applied to a connection point between the constant current source IaT1 and the constant current source IaT2, a connection point between the constant current source IbTdelay and the capacitor Ca, and a non-inverting input terminal of the comparator Comp1. Furthermore, a reference voltage Vb is applied to an inverting input terminal of the comparator Comp1, and an output of the comparator Comp1 is outputted to the switch SW3 (FIG. 3).

Figure 5:
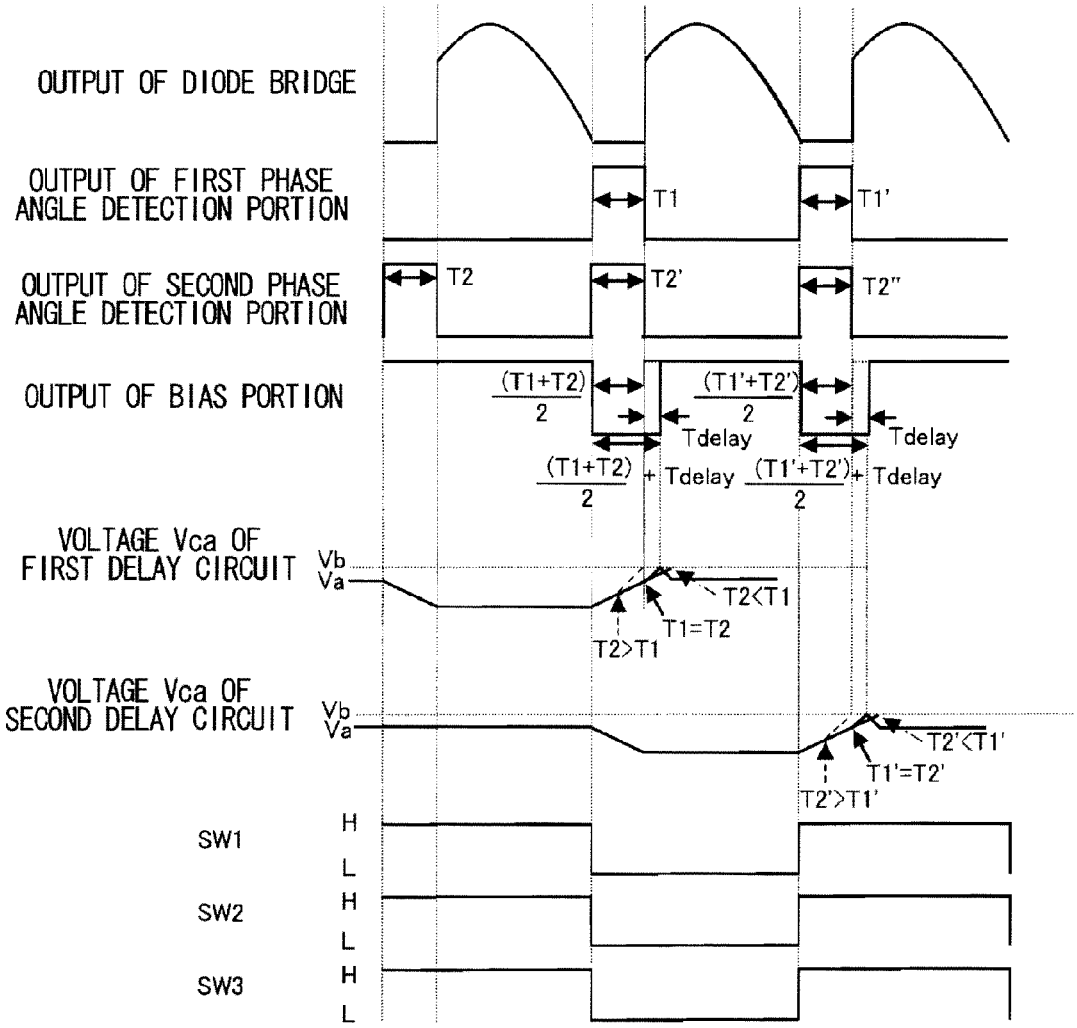
FIG. 5 is a timing chart for illustrating operations of the delay circuits included in the bias portion shown in FIG. 3.

Now, the following describes an operation of the delay circuit with reference to a timing chart shown in FIG. 5. First, upon switching of the switches SW1 to SW3 to H, in the first delay circuit 9*a*, for a time period (T2 in FIG. 5) of a phase angle detected by the second phase angle detection portion 7, the constant current source IaT2 passes a constant current Ia so that the capacitor Ca is discharged (an end voltage Vca of the capacitor Ca becomes lower than the reference voltage Va). Then, upon switching of the switches SW1 to SW3 to L at a zero-crossing point of an output voltage of the diode bridge DB1, in the first delay circuit 9*a*, for a time period (T1 in FIG. 5) of a phase angle detected by the first phase angle detection portion 6, the constant current source IaT1 passes the constant current Ia so that the capacitor Ca is charged, and immediately after that, the constant current source IbTdelay passes a constant current Ib. Then, at the time the end voltage Vca of the capacitor Ca attains the level of the reference voltage Vb, an output of the comparator Comp1 is turned from a low level to a high level, so that an output of the bias portion 8 is turned from a low level to a high level. The output of the bias portion 8 is maintained at the high level by the latch portion 10. Further, in the first delay circuit 9*a*, the passage of the constant current Ib is stopped, and through switching-on of the switch SW, the end voltage Vca of the capacitor Ca is maintained at the level of the reference voltage Va.

The end voltage Vca of the capacitor Ca is expressed by $$Vca=Va+(-Ia\times T2+Ia\times T1+Ib\times Td)/Ca$$ (*Ca* represents a capacitance of the capacitor *Ca*).

Assuming that Vca=Vb and Ib=2Ia,

T1+Td representing a phase angle detected by the bias portion 8 is expressed by $$T1+Td=(T1+T2)/2+T\text{delay}.$$

In this case, however, Tdelay=(Vb−Va)×Ca/Ib.

That is, a phase angle detected by the bias portion 8 is defined to be a phase angle obtained by adding the delay time Tdelay to a phase angle obtained by averaging T1 and T2.

Furthermore, at this time, in the second delay circuit 9*b*, the switch SW is switched off, and for a time period (T2' in FIG. 5) of a phase angle detected by the second phase angle detection portion 7, the constant current source IaT2 passes the constant current Ia so that the capacitor Ca is discharged (the end voltage Vca of the capacitor Ca becomes lower than the reference voltage Va).

Then, upon switching of the switches SW1 to SW3 to H at a zero-crossing point of an output voltage of the diode bridge DB1, an output of the second delay circuit 9*b*, which is at a low level, is outputted to the drive portion 5, so that an output of the bias portion 8 is turned to a low level. In the second delay circuit 9*b*, for a time period (T1' in FIG. 5) of a phase angle detected by the first phase angle detection portion 6, the constant current source IaT1 passes the constant current Ia so that the capacitor Ca is charged, and immediately after that, the constant current source IbTdelay passes the constant current Ib. Then, at the time the end voltage Vca of the capacitor Ca attains the level of the reference voltage Vb, an output of the comparator Comp1 is turned from a low level to a high level, so that an output of the bias portion 8 is turned from a low level to a high level. The output of the bias portion 8 is maintained at the high level by the latch portion 10. Further, in the second delay circuit 9*b*, the passage of the constant current Ib is stopped, and through switching-on of the switch SW, the end voltage Vca of the capacitor Ca is maintained at the level of the reference voltage Va. Furthermore, at this time, in the first delay circuit 9*a*, the switch SW is switched off, and for a time period (T2" in FIG. 5) of a phase angle detected by the second phase angle detection portion 7, the constant current source IaT2 passes the constant current Ia so that the capacitor Ca is discharged (the end voltage Vca of the capacitor Ca becomes lower than the reference voltage Va). Thereafter, a similar operation is performed repeatedly.

Figure 6:
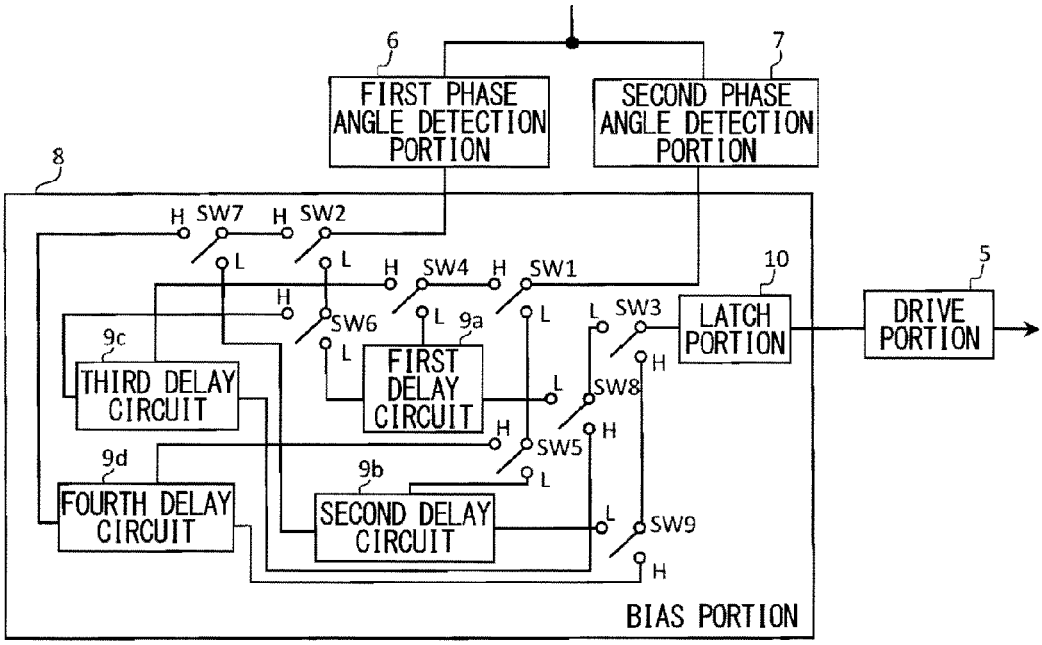
FIG. 6 is a diagram showing a modification example of the bias portion shown in FIG. 3.
Figure 7:
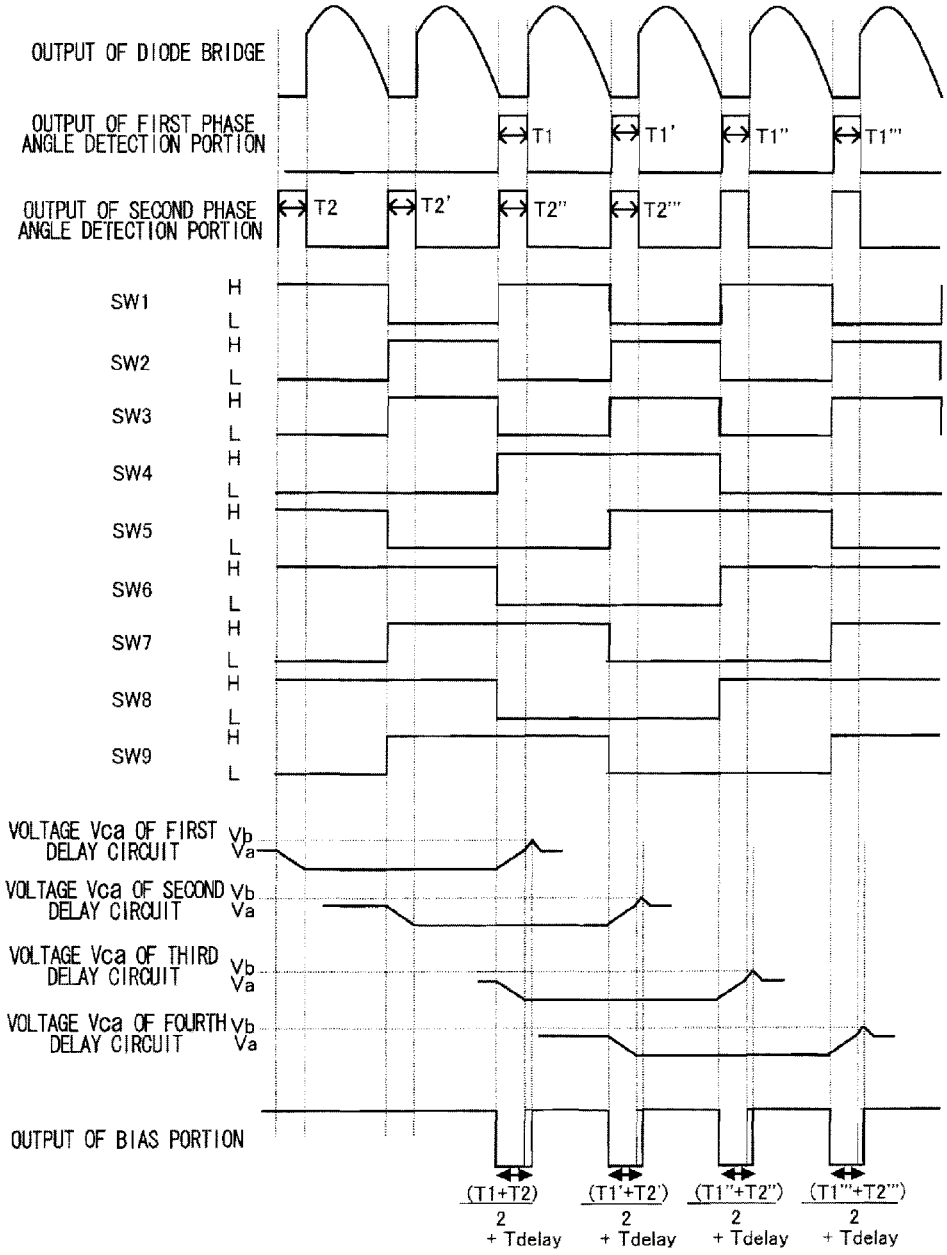
FIG. 7 is a timing chart for illustrating operations of delay circuits included in the bias portion shown in FIG. 6.

Furthermore, FIG. 6 shows a modification example of the specific configuration of the bias portion. A bias portion 8 shown in FIG. 6 has a first delay circuit 9*a*, a second delay circuit 9*b*, a third delay circuit 9*c*, a fourth delay circuit 9*d*, switches SW1 to SW9, and a latch portion 10. It is assumed that all the delay circuits have the configuration shown in FIG. 4. FIG. 7 shows a timing chart of timings at the various parts in a case where the bias portion 8 shown in FIG. 6 is used.

First, upon switching of the switches SW1, SW5, SW6, and SW8 to H and switching of the switches SW2, SW3, SW4, SW7, and SW9 to L, in the first delay circuit 9*a*, for a time period (T2 in FIG. 7) of a phase angle detected by the second phase angle detection portion 7, the constant current source IaT2 passes the constant current Ia so that the capacitor Ca is discharged (the end voltage Vca of the capacitor Ca becomes lower than the reference voltage Va). Then, upon switching of the switches SW2, SW3, SW6, SW7, SW8, and SW9 to H and switching of the switches SW1, SW4, and SW5 to L at a zero-crossing point of an output voltage of the diode bridge DB1, in the second delay circuit 9*b*, for a time period (T2' in FIG. 7) of a phase angle detected by the second phase angle detection portion 7, the constant current source IaT2 passes the constant current Ia so that the capacitor Ca is discharged (the end voltage Vca of the capacitor Ca becomes lower than the reference voltage Va).

Then, upon switching of the switches SW1, SW4, SW7, and SW9 to H and switching of the switches SW2, SW3, SW5, SW6, and SW8 to L at a zero-crossing point of an output voltage of the diode bridge DB1, in the first delay circuit 9*a*, for a time period (T1 in FIG. 7) of a phase angle detected by the first phase angle detection portion 6, the constant current source IaT1 passes the constant current Ia so that the capacitor Ca is charged, and immediately after that, the constant current source IbTdelay passes the constant current Ib. Then, at the time the end voltage Vca of the capacitor Ca attains the level of the reference voltage Vb, an output of the comparator Comp1 is turned from a low level to a high level, so that an output of the bias portion 8 is switched from a low level to a high level. The output of the bias portion 8 is maintained at the high level by the latch portion 10. Further, in the first delay circuit 9*a*, the passage of the constant current Ib is stopped, and through switching-on of the switch SW, the end voltage Vca of the capacitor Ca is maintained at the level of the reference voltage Va. A phase angle detected by the bias portion 8 is defined to be a phase angle obtained by adding a delay time Tdelay to a phase angle obtained by averaging the detected phase angle T1 in a present cycle and the detected phase angle T2 in a second immediately preceding cycle ("Output of bias portion" in FIG. 7). Similarly, in each of the second delay circuit 9*b*, the third delay circuit 9*c*, and the fourth delay circuit 9*d*, discharging and charging of the capacitor Ca are performed, and thus the bias portion 8 sequentially detects a phase angle obtained by adding a delay time to a phase angle obtained by averaging a detected phase angle in a present cycle and a detected phase angle in a second immediately preceding cycle.

Absolute values of the constant current Ia used to charge/discharge the above-described capacitor Ca and the constant current Ib or the ratio between the constant current Ia and the constant current Ib may be set to be externally adjustable so that a phase angle averaging rate and a delay time can be adjusted. With this configuration, even if an already-existing light controller having a function of reducing a variation in phase angle in response to a variation in power possibly fails to sufficiently fulfill the function due to a power source state at an installation site thereof, a phase angle averaging rate and a phase angle averaging range can be externally adjusted. Furthermore, a delay time may be adjusted by externally replacing the capacitor Ca.

Figure 8:
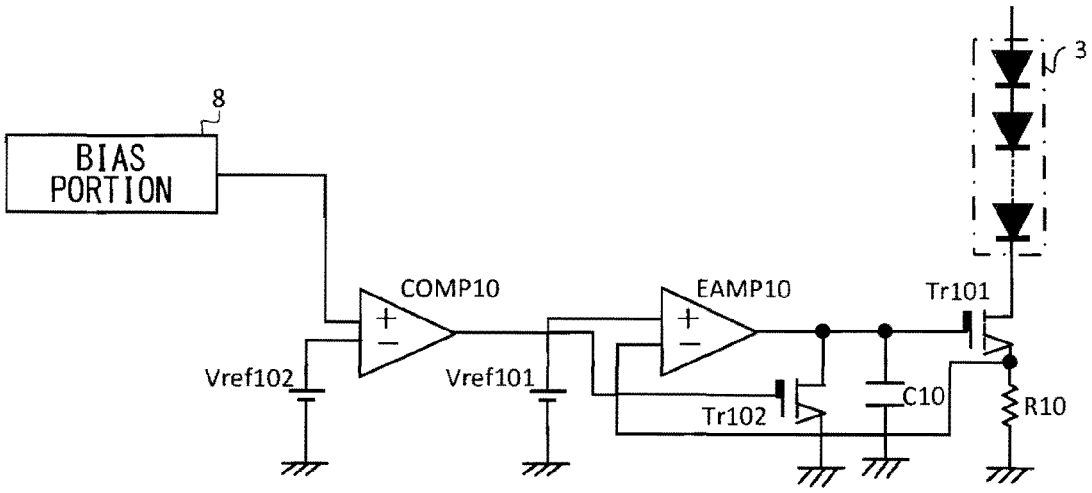
FIG. 8 is a diagram showing a specific configuration example of a drive portion and a current limitation circuit.

Next, the following describes a specific configuration example of the drive portion 5 and the current limitation circuit 4 with reference to FIG. 8. In FIG. 8, the drive portion 5 has a comparator COMP10, a transistor Tr102, and a capacitor C10. Furthermore, the current limitation circuit 4 has a transistor Tr101, a resistor R10, and an error amplifier EAMP10.

The error amplifier EAMP10 compares a voltage into which a current is converted by the resistor R10 with a reference voltage Vref101 and based on a result thereof; controls a gate voltage of the transistor TR101 so that these voltages are equal to each other, thereby performing control so that a constant current is passed through the LED module 3. Furthermore, the comparator COMP10 compares an output of the bias portion 8 with a reference voltage Vref102 and based on a result thereof, controls a gate voltage of the transistor Tr102. If an output of the bias portion 8 is at a low level, the transistor Tr102 is switched on, so that the transistor Tr101 is switched off, and thus no current flows through the LED module 3. If the output of the bias portion 8 is turned to a high level, the transistor Tr102 is switched off, so that the capacitor C10 is charged to cause the gate voltage of the transistor Tr101 to rise at a predetermined time constant, and thus a current is slowly passed through the LED module 3.

Figure 9:
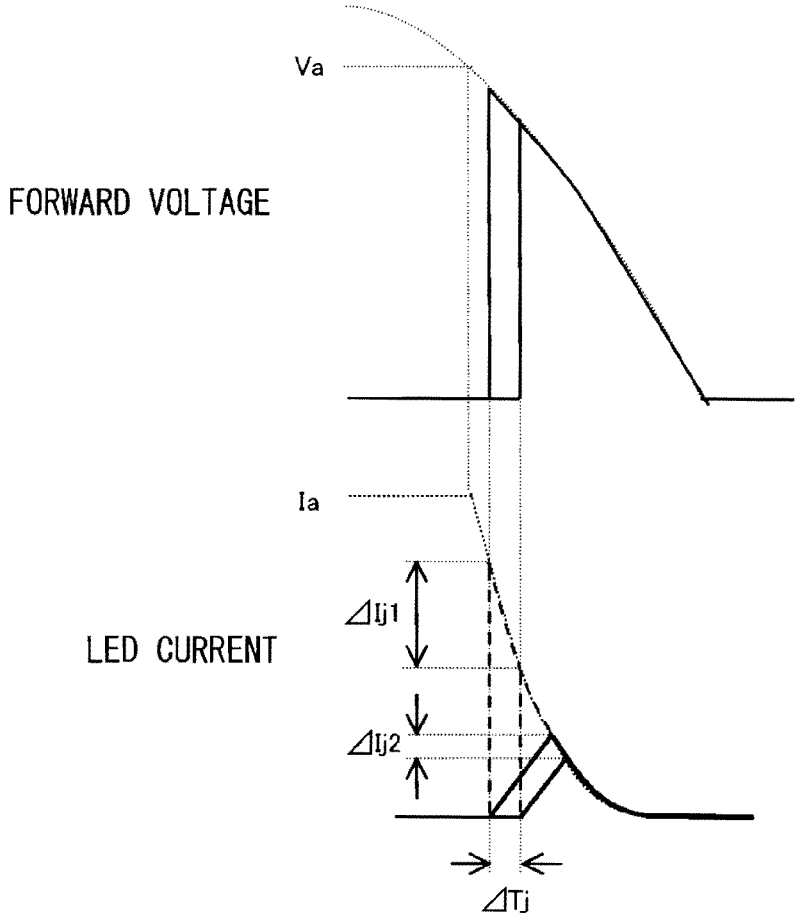
FIG. 9 is a diagram showing a relationship between a forward voltage applied to an LED module and a current flowing through the LED module.

Under low-brightness light control, a voltage applied to the LED module 3 when an output of the bias portion 8 rises is, as shown in FIG. 9, lower than the voltage Va corresponding to the current Ia to be limited. In a case of a configuration in which the transistor Tr101 is switched on immediately upon rising of an output of the bias portion 8, a current flows through the LED module 3 as shown by a chain line in FIG. 9. In this case, if a variation ΔTj in phase angle occurs, there occurs a variation ΔIj1 in current flowing through the LED module 3, which is large. As a solution to this, the capacitor C10 shown in FIG. 8 is provided to perform control so that a current is slowly passed through the LED module 3 when an output of the bias portion 8 rises. In this case, a current flows through the LED module 3 as shown by a solid line in FIG. 9, so that the amount of a variation in current in the LED module 3 with respect to the variation ΔTj in phase angle is reduced to ΔIj2. This technique combined with the technique of reducing a variation in phase angle by phase angle averaging reduces a variation in current in the LED module 3 under low-brightness light control.

An output of the diode bridge DB1 may be inputted to a non-inverting input terminal of the comparator COMP10 in FIG. 8. In this case, the reference voltage Vref102 may be set to be externally adjustable. Moreover, the reference voltage Vref102 may be adjusted so as to correspond to a forward voltage obtained when the LED module 3 that is driven starts to glow.

Figure 10:
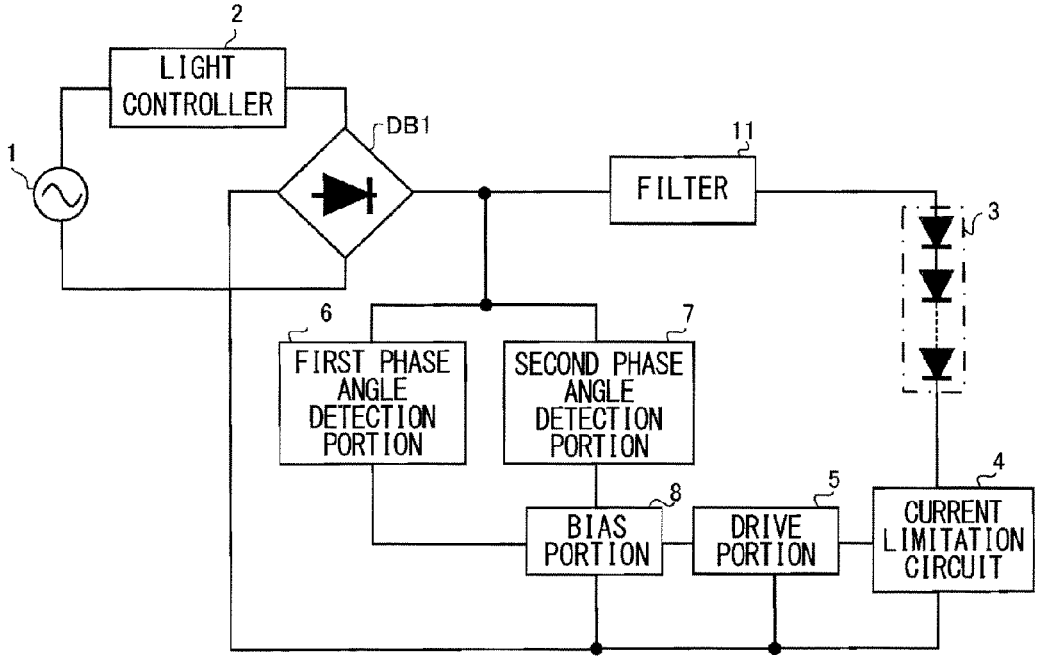
FIG. 10 is a diagram showing an example in which a filter is inserted in a power source line.
Figure 11:
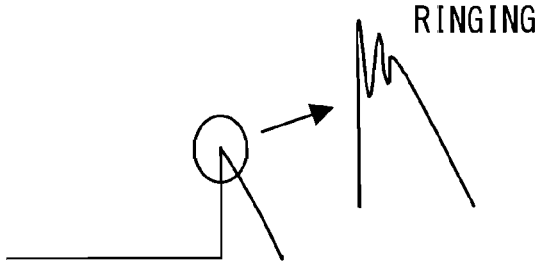
FIG. 11 is a diagram showing an example in which ringing has occurred in input power.
Figure 19:
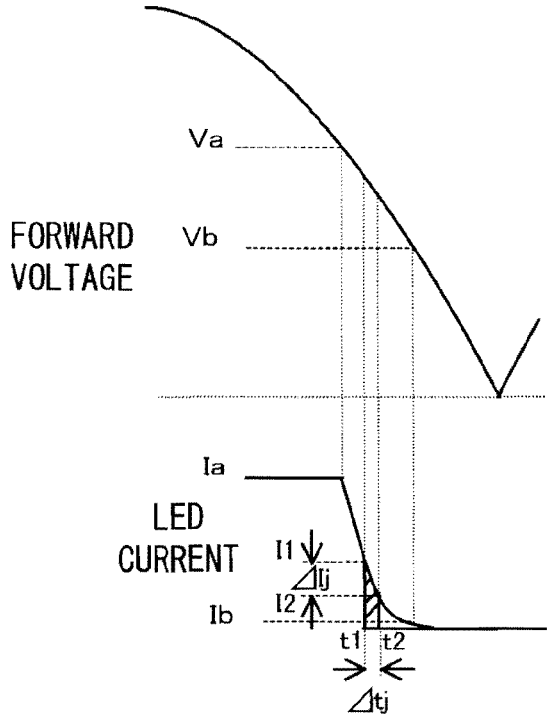
FIG. 19 is a diagram showing a relationship between a forward voltage applied to the LED module and a current flowing through the LED module.

Furthermore, FIG. 10 shows a configuration example in which a filter 11 is inserted in a power source line for supplying power to the LED module 3. In performing phase-control light control, decreasing the amount of light used (i.e. increasing a phase angle) may result in a case where a rising voltage of input power (an output voltage of the diode bridge DB1) falls short of a forward voltage corresponding to a predetermined limitation current. An example thereof is a case of a voltage equal to or lower than the voltage Va shown in FIG. 19, in which there occurs a variation in current depending on a voltage applied to the LED module 3. In this case, if, upon switching-on of a triac included in the phase-control light controller 2, a ringing waveform (FIG. 11) is generated in input power, a current flowing through the LED module 3 fluctuates. Ringing occurs at a frequency of about several tens of kHz and is therefore not sensed by the human eye. If, however, the amount of ringing changes in every cycle, flickering is perceived as occurring at a frequency sufficient for the human eye to sense it. Such ringing that causes a variation can be reduced by, as shown in FIG. 10, inserting the filter 11, which is a low-pass filter, in the power source line for supplying power to the LED module 3. For example, assuming that a relationship between a rising time Tr and a cutoff frequency Fc of a low-pass filter is expressed by Fc=0.35/Tr, the rising time is set to about 0.1 ms to 1 ms.

In the power source line, an inductor may be inserted in series with the LED module 3. Furthermore, a capacitor may be connected in parallel with the LED module 3.

Modifications and Variations

In addition to the foregoing embodiment of the present invention as one example, following configurations are also possible. For example, an input voltage of the LED drive circuit according to the present invention is not limited to a commercial power source voltage of 100 V used in Japan. With a circuit constant of the LED drive circuit according to the present invention set to an appropriate value, a commercial power source voltage used outside Japan or a stepped-down alternating current voltage can be used as an input voltage of the LED drive circuit according to the present invention.

Furthermore, adding a protection element such as a current fuse to the LED drive circuit according to the present invention allows a safer LED drive circuit to be provided.

Furthermore, in the foregoing LED drive circuit, the current limitation circuit 4 is connected to an anode side of the LED module 3. With respective circuit constants set appropriately, however, there is no problem in connecting the current limitation circuit 4 to a cathode side of the LED module 3.

Furthermore, the current limitation circuit 4 is a circuit portion for preventing a current equal to or larger than a rated current from flowing through the LED module 3. There are possible cases where the current limitation circuit 4 performs current limitation by use of only a passive element such as a resistor and by combined use of a resistor and an active element such as a transistor.

Furthermore, in a case where a current having a sufficient margin with respect to a rated current is passed through the LED module 3, omitting the current limitation circuit 4 has no effect on a light control operation and so on.

Furthermore, a phase-control light controller used together with the LED drive circuit according to the present invention is not limited to the configuration (see FIG. 20) of the phase-control light controller 2.

Furthermore, a voltage inputted to the LED drive circuit according to the present invention is not limited to a voltage based on an alternating current voltage having a sinusoidal waveform and may be an alternating current voltage having another waveform.

Furthermore, the foregoing embodiment and the above-described modification examples can be implemented in arbitrary combination as long as no contradiction is entailed by such a combination.

<Regarding LED Illumination Component According to the Present Invention>

Figure 12:
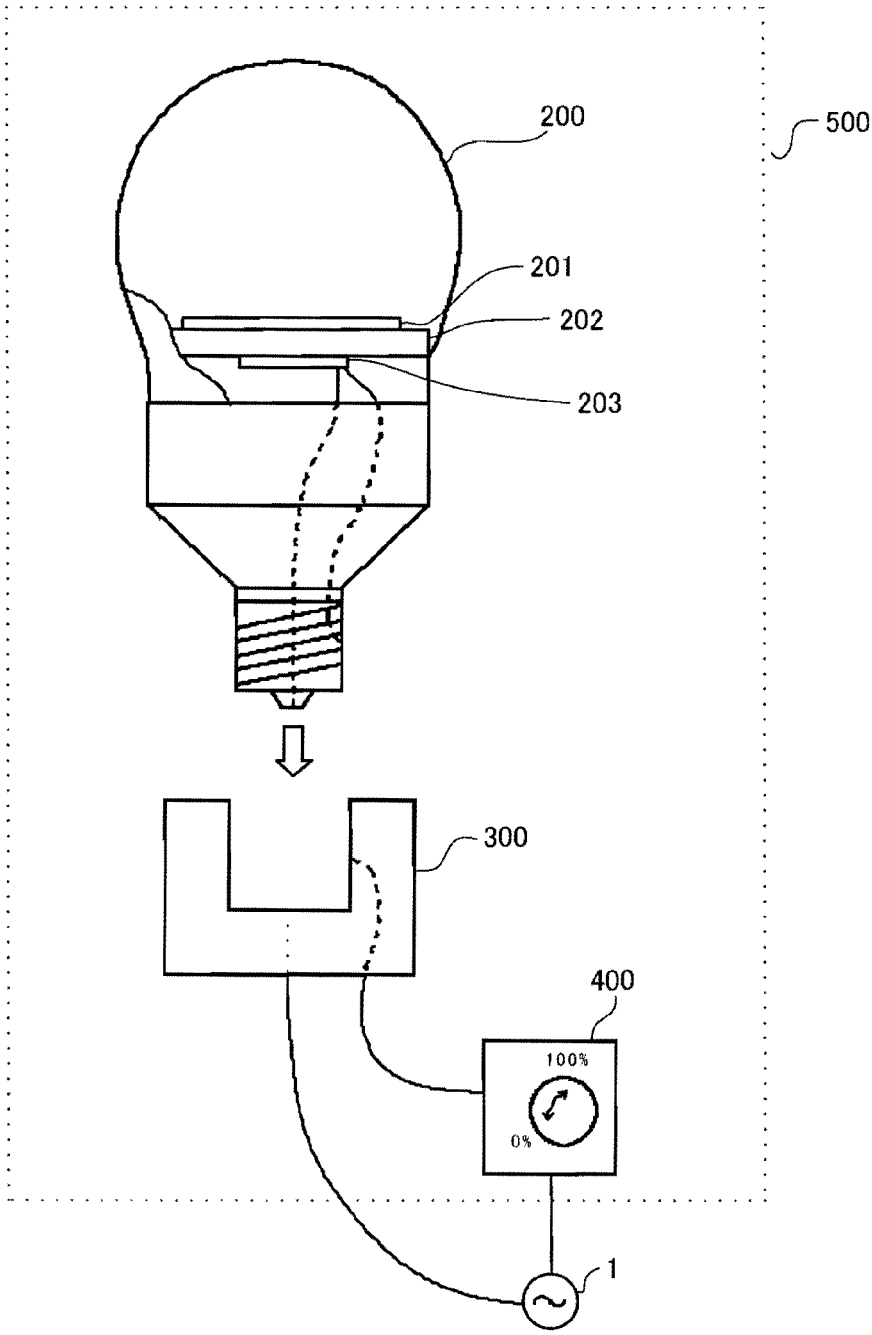
FIG. 12 is a diagram showing a schematic structural example of an LED illumination component, an LED illumination device, and the LED illumination system according to the present invention.

Finally, the following describes a schematic structure of an LED illumination component according to the present invention. FIG. 12 shows a schematic structural example of the LED illumination component according to the present invention, an LED illumination device according to the present invention, and the LED illumination system according to the present invention. In FIG. 12, an electric bulb-shaped LED illumination component 200 according to the present invention is shown in a partially cutaway view. The electric bulb-shaped LED illumination component 200 according to the present invention internally includes a cylindrical body or substrate 202, an LED module 201 composed of one or more LEDs and installed on the front of the cylindrical body or substrate 202 (on the head side of the electric bulb shape), and a circuit 203 installed on the back of the cylindrical body or substrate 202 (on the lower side of the electric bulb shape). As the circuit 203, for example, any of the foregoing examples of the LED drive circuit according to the present invention can be used.

An LED illumination component mounting portion 300 in which the electric bulb-shaped LED illumination component 200 according to the present invention is mounted by being screwed thereinto and a light controller (phase-control light controller) 400 are connected in series to an alternating current power source 1. The electric bulb-shaped LED illumination component 200 according to the present invention and the LED illumination component mounting portion 300 constitute an LED illumination device (a ceiling light, a pendant light, a kitchen light, a downlight, a stand light, a spot light, a foot light, or the like). The electric bulb-shaped LED illumination component 200 according to the present invention, the LED illumination component mounting portion 300, and the light controller 400 constitute an LED illumination system 500 according to the present invention. The LED illumination component mounting portion 300 is attached to, for example, an interior ceiling wall surface, and the light controller 400 is attached to, for example, an interior side wall surface.

The electric bulb-shaped LED illumination component 200 according to the present invention is demountable from the LED illumination component mounting portion 300. Thus, for example, in an existing illumination device and an existing illumination system that conventionally use an illumination component such as an incandescent lamp or a fluorescent lamp, by simply replacing the illumination component such as an incandescent lamp or a fluorescent lamp with the electric bulb-shaped LED illumination component 200 according to the present invention, light control by the already-existing light controller 400 is enabled.

Figure 20:
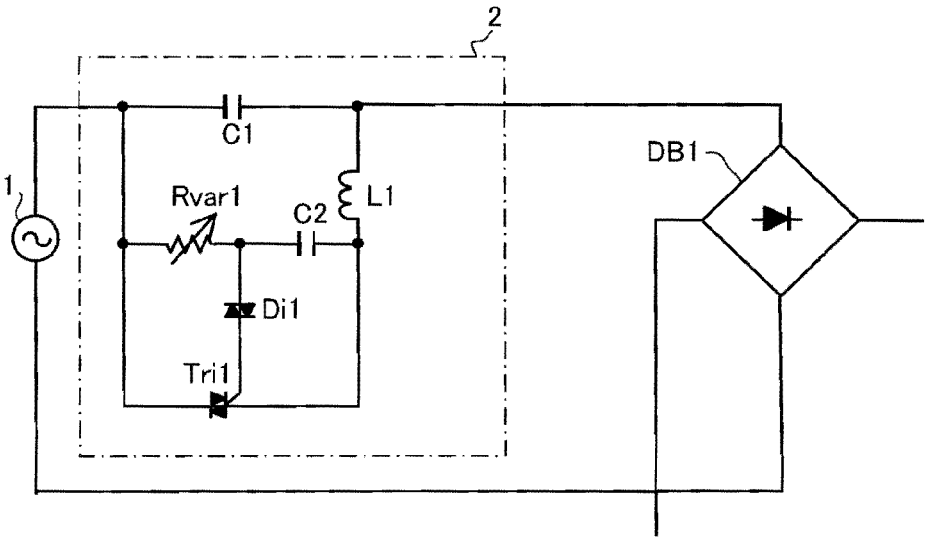
FIG. 20 is a diagram showing a configuration example of a phase-control light controller.

In FIG. 12, there is shown an outer appearance of the light controller 400 in a case where the phase-control light controller 2 shown in FIG. 20 is used as the light controller 400, and the light controller 400 is configured so that the degree of light control can be changed through the operation on a volume element in the form of a knob. Needless to say, in place of a volume element in the form of a knob, a volume element in the form of a slider may also be used to change the degree of light control.

The foregoing description is directed to a case where a human directly operates the light controller 400 via a volume element in the form of a knob or a slider. There is no limitation thereto, however, and a remote operation may also be adopted in which a human performs an operation through transmission of a radio signal via a remote controller or the like. Such a remote operation is enabled by providing the main body of the light controller on the reception side with a radio signal reception portion and providing the main body of a transmitter (for example, a remote control transmitter, a portable terminal, or the like) on the transmission side with a radio signal transmission portion that transmits a light manipulation signal (for example, a light control signal, a light on/off signal, or the like) to the above-described radio signal reception portion.

Figure 13:
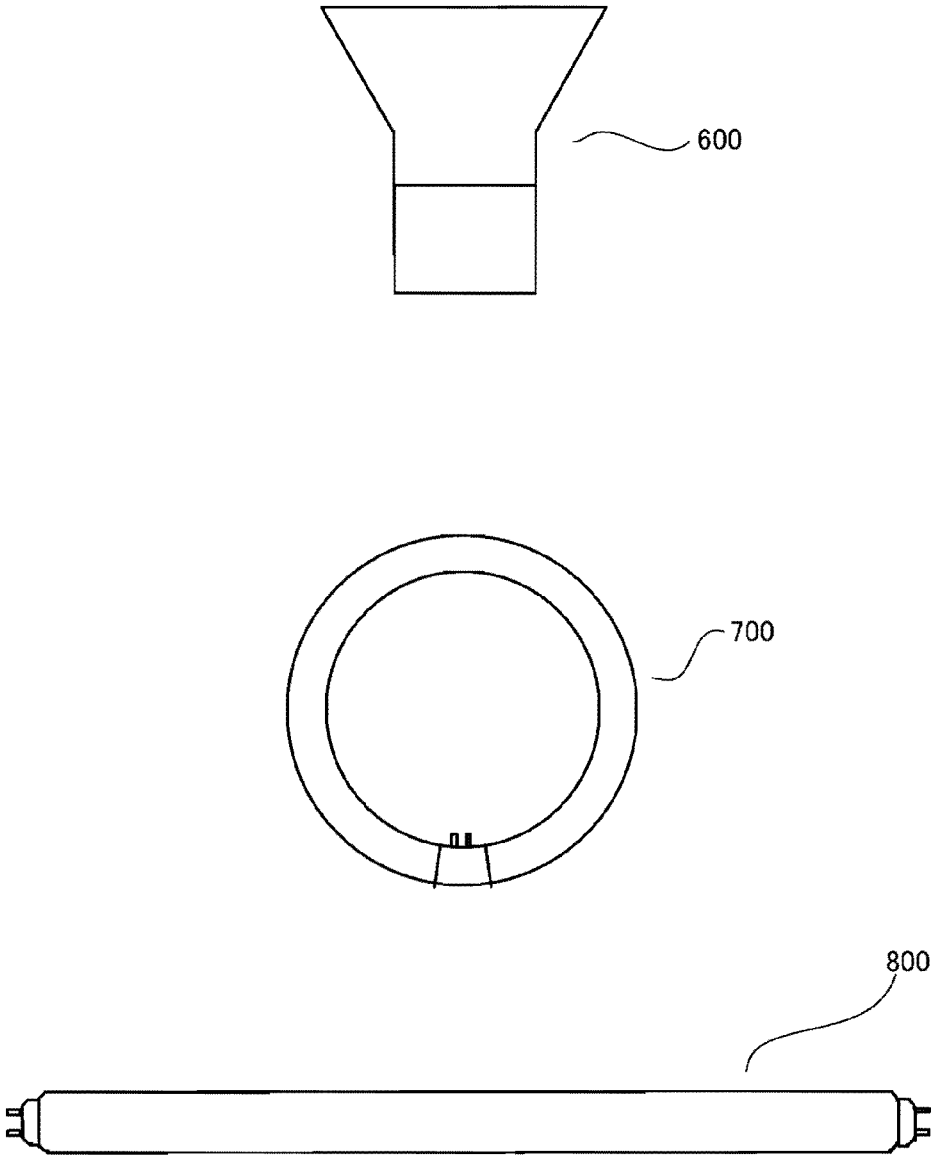
FIG. 13 is a diagram showing a modification example of the LED illumination component according to the present invention.
Figure 14:
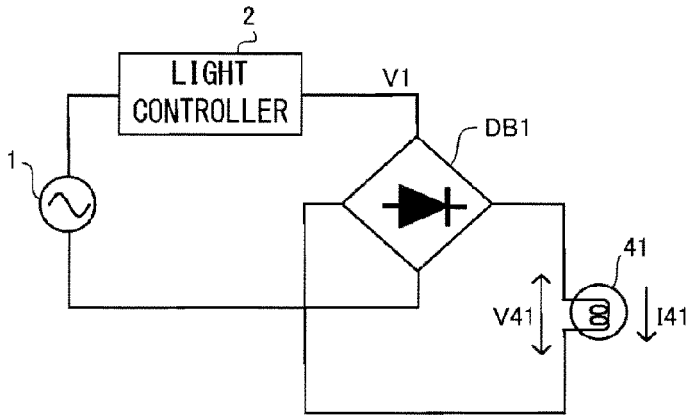
FIG. 14 is a diagram showing a conventional example of an incandescent lamp illumination system.
Figure 15:
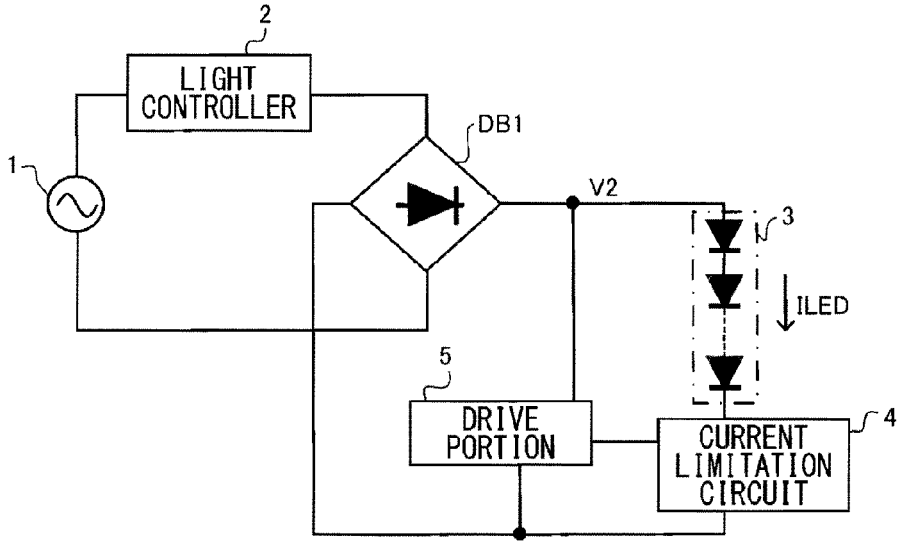
FIG. 15 is a diagram showing a conventional example of an LED illumination system.
Figure 16:
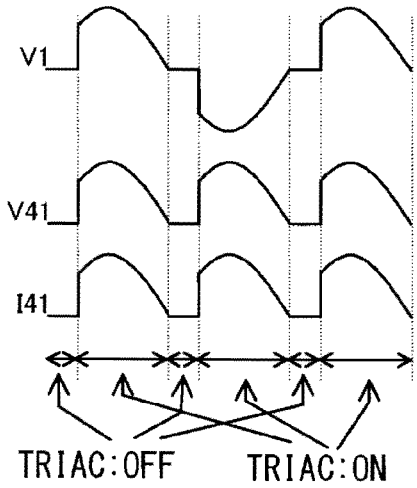
FIG. 16 is a diagram showing waveforms at various parts of the incandescent lamp illumination system shown in FIG. 14.
Figure 17A:
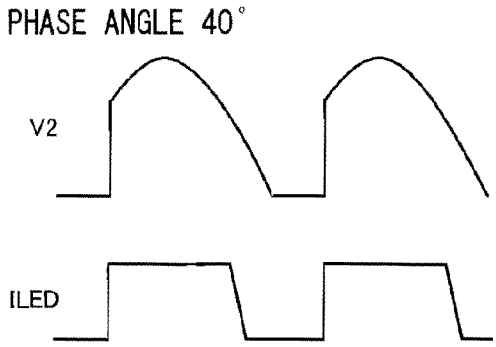
FIG. 17A is a diagram showing waveforms at various parts of the LED illumination system shown in FIG. 15 under high-brightness light control.
Figure 17B:
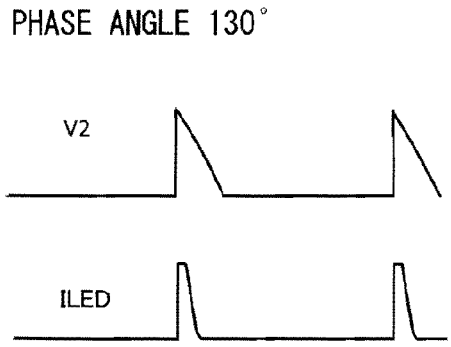
FIG. 17B is a diagram showing waveforms at the various parts of the LED illumination system shown in FIG. 15 under low-brightness light control.
Figure 18:
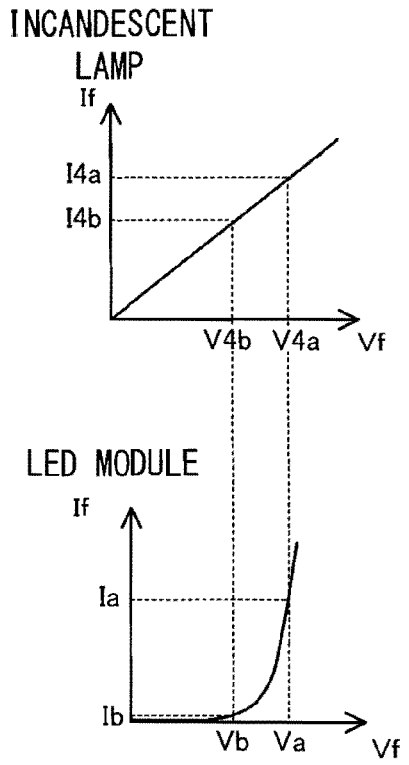
FIG. 18 is a diagram showing a VF-IF curve of each of an incandescent lamp and an LED module.

Furthermore, the LED illumination component according to the present invention is not limited to an electric bulb-shaped LED illumination component and may be, for example, an electric lamp-shaped LED illumination component 600, a ring-shaped LED illumination component 700, or a straight tube-shaped LED illumination component 800 shown in FIG. 13. The LED illumination component according to the present invention, whatever shape it takes, is connectable to an LED and to a phase-control light controller and internally includes at least an LED drive circuit that drives the LED by use of an alternating current voltage inputted thereto and varies the driving timing in accordance with a variation in input power.

What is claimed is:

1. An LED drive circuit that is connectable to a phase-control light controller and drives an LED load by use of a voltage obtained by rectifying a phase-controlled alternating current voltage inputted from the phase-control light controller, comprising:

a first phase angle detection portion that detects a phase angle in a present cycle;

a second phase angle detection portion that detects a phase angle in a cycle preceding the present cycle by at least one cycle;

a bias portion that generates a detection signal by adding a predetermined delay time to a phase angle obtained by averaging the phase angle detected by the first phase angle detection portion and the phase angle detected by the second phase angle detection portion; and a drive portion that starts current supply to the LED load at timing based on the detection signal generated by the bias portion.

2. The LED drive circuit according to claim 1, wherein the bias portion includes a delay circuit having:

a capacitor;

a charging/discharging circuit that discharges the capacitor, which has been charged to a predetermined voltage, by use of a first constant current for a time period of a phase angle in a cycle preceding the present cycle by one cycle detected by the second phase angle detection portion, charges the capacitor by use of the first constant current for a time period of the phase angle in the present cycle detected by the first phase angle detection portion, and then further charges the capacitor by use of a second constant current; and a detection circuit that detects that a voltage of the capacitor has attained a predetermined voltage after the charging of the capacitor by use of the second constant current.

3. The LED drive circuit according to claim 1, wherein the bias portion includes a delay circuit having:

a capacitor;

a charging/discharging circuit that discharges the capacitor, which has been charged to a predetermined voltage, by use of a first constant current for a time period of a phase angle in a cycle preceding the present cycle by two cycles detected by the second phase angle detection portion, charges the capacitor by use of the first constant current for a time period of the phase angle in the present cycle detected by the first phase angle detection portion, and then further charges the capacitor by use of a second constant current; and a detection circuit that detects that a voltage of the capacitor has attained a predetermined voltage after the charging of the capacitor by use of the second constant current.

4. The LED drive circuit according to claim 2, wherein absolute values of the first constant current and the second constant current or a ratio between the first constant current and the second constant current are externally adjustable.

5. The LED drive circuit according to claim 3, wherein absolute values of the first constant current and the second constant current or a ratio between the first constant current and the second constant current are externally adjustable.

6. The LED drive circuit according to claim 1, wherein the drive portion stops the current supply to the LED load when the detection signal generated by the bias portion has a voltage not higher than a predetermined voltage and starts the current supply to the LED load at a predetermined time constant when the detection signal generated by the bias portion has a voltage exceeding the predetermined voltage.

7. The LED drive circuit according to claim 1, wherein in a power supply line of the LED load, a filter is provided that reduces switching noise generated upon switching-on of a switching element in the phase-control light controller.

8. An LED illumination component, comprising:

an LED drive circuit that is connectable to a phase-control light controller and drives an LED load by use of a voltage obtained by rectifying a phase-controlled alternating current voltage inputted from the phase-control light controller, the LED drive circuit including:

a first phase angle detection portion that detects a phase angle in a present cycle;

a second phase angle detection portion that detects a phase angle in a cycle preceding the present cycle by at least one cycle;

a bias portion that generates a detection signal by adding a predetermined delay time to a phase angle obtained by averaging the phase angle detected by the first phase angle detection portion and the phase angle detected by the second phase angle detection portion; and a drive portion that starts current supply to the LED load at timing based on the detection signal generated by the bias portion; and the LED load that is connected to an output side of the LED drive circuit.

9. An LED illumination device, comprising:

an LED drive circuit that is connectable to a phase-control light controller and drives an LED load by use of a voltage obtained by rectifying a phase-controlled alternating current voltage inputted from the phase-control light controller, the LED drive circuit including:

a first phase angle detection portion that detects a phase angle in a present cycle;

a second phase angle detection portion that detects a phase angle in a cycle preceding the present cycle by at least one cycle;

a bias portion that generates a detection signal by adding a predetermined delay time to a phase angle obtained by averaging the phase angle detected by the first phase angle detection portion and the phase angle detected by the second phase angle detection portion; and a drive portion that starts current supply to the LED load at timing based on the detection signal generated by the bias portion.

10. An LED illumination device, comprising:

an LED illumination component including:

an LED drive circuit that is connectable to a phase-control light controller and drives an LED load by use of a voltage obtained by rectifying a phase-controlled alternating current voltage inputted from the phase-control light controller, the LED drive circuit including:

a first phase angle detection portion that detects a phase angle in a present cycle;

a second phase angle detection portion that detects a phase angle in a cycle preceding the present cycle by at least one cycle;

a bias portion that generates a detection signal by adding a predetermined delay time to a phase angle obtained by averaging the phase angle detected by the first phase angle detection portion and the phase angle detected by the second phase angle detection portion; and a drive portion that starts current supply to the LED load at timing based on the detection signal generated by the bias portion; and the LED load that is connected to an output side of the LED drive circuit.

11. An LED illumination system, comprising:

an LED illumination component including:

an LED drive circuit that is connectable to a phase-control light controller and drives an LED load by use of a voltage obtained by rectifying a phase-controlled alternating current voltage inputted from the phase-control light controller, the LED drive circuit including:

a first phase angle detection portion that detects a phase angle in a present cycle;

a second phase angle detection portion that detects a phase angle in a cycle preceding the present cycle by at least one cycle;

a bias portion that generates a detection signal by adding a predetermined delay time to a phase angle obtained by averaging the phase angle detected by the first phase angle detection portion and the phase angle detected by the second phase angle detection portion; and a drive portion that starts current supply to the LED load at timing based on the detection signal generated by the bias portion; and the LED load that is connected to an output side of the LED drive circuit; and the phase-control light controller that is connected to an input side of the LED illumination component.

12. An LED illumination system, comprising:

an LED illumination device including:

an LED drive circuit that is connectable to a phase-control light controller and drives an LED load by use of a voltage obtained by rectifying a phase-controlled alternating current voltage inputted from the phase-control light controller, the LED drive circuit including:

a first phase angle detection portion that detects a phase angle in a present cycle;

a second phase angle detection portion that detects a phase angle in a cycle preceding the present cycle by at least one cycle;

a bias portion that generates a detection signal by adding a predetermined delay time to a phase angle obtained by averaging the phase angle detected by the first phase angle detection portion and the phase angle detected by the second phase angle detection portion; and a drive portion that starts current supply to the LED load at timing based on the detection signal generated by the bias portion; and the phase-control light controller that is connected to an input side of the LED illumination device.

13. An LED illumination system, comprising:

an LED illumination device including:

an LED illumination component including:

an LED drive circuit that is connectable to a phase-control light controller and drives an LED load by use of a voltage obtained by rectifying a phase-controlled alternating current voltage inputted from the phase-control light controller, the LED drive circuit including:

a first phase angle detection portion that detects a phase angle in a present cycle;

a second phase angle detection portion that detects a phase angle in a cycle preceding the present cycle by at least one cycle;

a bias portion that generates a detection signal by adding a predetermined delay time to a phase angle obtained by averaging the phase angle detected by the first phase angle detection portion and the phase angle detected by the second phase angle detection portion; and a drive portion that starts current supply to the LED load at timing based on the detection signal generated by the bias portion; and the LED load that is connected to an output side of the LED drive circuit; and the phase-control light controller that is connected to an input side of the LED illumination device.

* * * * *